US009538834B2

(12) United States Patent
Dietmeyer et al.

(10) Patent No.: US 9,538,834 B2
(45) Date of Patent: Jan. 10, 2017

(54) PAINT CAN HOLDING APPRATUS AND METHOD

(71) Applicants: Brian J. Dietmeyer, Chicago, IL (US); Scott Padiak, Glencoe, IL (US)

(72) Inventors: Brian J. Dietmeyer, Chicago, IL (US); Scott Padiak, Glencoe, IL (US)

( * ) Notice: Subject to any disclaimer, the term of this patent is extended or adjusted under 35 U.S.C. 154(b) by 121 days.

(21) Appl. No.: 14/201,431

(22) Filed: Mar. 7, 2014

(65) Prior Publication Data

US 2015/0250296 A1 Sep. 10, 2015

(51) Int. Cl.
*A45F 5/02* (2006.01)
*B44D 3/14* (2006.01)

(52) U.S. Cl.
CPC ..... *A45F 5/02* (2013.01); *A45F 5/021* (2013.01); *B44D 3/14* (2013.01)

(58) Field of Classification Search
CPC .. A45F 5/02; A45F 2005/026; A45F 2200/05; A45F 2200/0575; B44D 3/14
USPC ..... 248/210, 312.1, 313, 211
See application file for complete search history.

(56) References Cited

U.S. PATENT DOCUMENTS

| | | | | |
|---|---|---|---|---|
| 246,680 | A | 9/1881 | Knous | |
| 1,109,161 | A | 9/1914 | Chindgren | |
| 2,236,187 | A * | 3/1941 | Penney | 248/210 |
| 2,524,875 | A | 10/1950 | Beaver | |
| 2,709,540 | A * | 5/1955 | Kenney | 141/328 |
| 2,717,109 | A | 9/1955 | Walsh | |
| 2,788,153 | A | 4/1957 | Broadbelt | |
| 2,884,216 | A * | 4/1959 | Joecks | 248/211 |
| 2,995,281 | A | 8/1961 | Dixon | |
| 3,227,411 | A | 1/1966 | Treutler | |
| 3,285,482 | A | 11/1966 | Bedsaul, Sr. | |
| 3,876,125 | A | 4/1975 | Emmert | |
| 4,013,251 | A | 3/1977 | Cleveland | |
| 4,053,131 | A | 10/1977 | Francis | |
| 4,172,542 | A | 10/1979 | Lankford | |
| 4,325,503 | A | 4/1982 | Swinney | |
| 4,433,801 | A | 2/1984 | Swinney | |
| 4,527,720 | A | 7/1985 | Hayes | |
| 4,534,528 | A | 8/1985 | Rousseau | |
| 4,746,042 | A | 5/1988 | King | |
| D296,269 | S | 6/1988 | Richardson et al. | |
| 4,951,857 | A | 8/1990 | Carr | |
| 4,962,906 | A | 10/1990 | Fatool et al. | |
| 5,176,302 | A | 1/1993 | Smith | |
| 5,358,161 | A | 10/1994 | Perugini | |

(Continued)

*Primary Examiner* — Nathan J Newhouse
*Assistant Examiner* — Phillip Schmidt
(74) *Attorney, Agent, or Firm* — David A. Gottardo

(57) ABSTRACT

A paint can holder for holding a paint can having an upper groove and lower lip comprises a bracket defining upper and lower ends, with the lower end defining a groove configured to accept the lower lip of the can therein. A clip and a lock operably are attached to the bracket proximal to the upper end. The lock is operably engageable with the upper groove of the can to removably secure the holder and can to one another. The clip is operably engageable with a belt or article of clothing. The holder preferably further includes a magnet located on the lock for magnetic engagement with a ferrous bristle binding of a paint brush to suspend the brush within about an interior of the can. In another embodiment, the paint can holder is adjustable to accommodate the holding of various sizes of the paint.

20 Claims, 8 Drawing Sheets

(56) References Cited

U.S. PATENT DOCUMENTS

| | | | | |
|---|---|---|---|---|
| 5,385,281 | A | 1/1995 | Byrd | |
| 5,489,051 | A | 2/1996 | Robinson | |
| 5,497,921 | A | 3/1996 | Dancyger et al. | |
| 5,695,098 | A | 12/1997 | King | |
| 6,006,966 | A | 12/1999 | Voisin, Jr. | |
| 6,045,017 | A * | 4/2000 | Connell | 224/148.7 |
| 6,138,963 | A | 10/2000 | Malvasio | |
| 6,394,304 | B1 | 5/2002 | Bohne et al. | |
| 6,557,738 | B1 | 5/2003 | Meintzer | |
| 6,565,051 | B2 | 5/2003 | Vaglica | |
| 6,641,011 | B1 | 11/2003 | Kahn | |
| 6,719,178 | B1 | 4/2004 | Taylor | |
| 6,848,605 | B2 | 2/2005 | Dillenberger | |
| 6,866,172 | B2 | 3/2005 | Shackleford | |
| 7,073,205 | B2 | 7/2006 | Finn | |
| D586,114 | S | 2/2009 | Ferguson | |
| 8,714,386 | B2 * | 5/2014 | Sasaki et al. | 215/396 |
| 2003/0024959 | A1 | 2/2003 | Armstrong | |
| 2005/0156085 | A1 | 7/2005 | Radovan | |
| 2006/0065668 | A1 | 3/2006 | Whitaker et al. | |
| 2007/0034761 | A1 | 2/2007 | De Boer | |
| 2008/0017771 | A1 | 1/2008 | Anderson | |
| 2008/0054030 | A1 * | 3/2008 | Diaz | 224/148.7 |

* cited by examiner 300
295
290
85
30
25
20
40
35
15
10
5
65
75
60
70
50
45
105
100
55
80
95

85
55
105
30
25
20
40
35
10
90
70
60
45
50
5

PAINT CAN HOLDING APPRATUS AND METHOD

TECHNICAL FIELD OF THE INVENTION

This invention relates generally to paint can holders, and more particularly to holders that will free the painter from holding the paint can while working in precarious positions and provide a practical means and location for storing the paint brush in relation to the can.

BACKGROUND OF THE INVENTION

Trimming out walls and ceilings during painting processes generally requires that the painter carry the paint can around as the paint is applied. However, supporting and handling the paint can during such trimming is awkward. For example, when painting in confined spaces, such as corners, ceiling/wall junctions or close to trim ("cutting in" as it is known in the trade), it may be necessary to utilize a ladder or scaffolding to provide a platform from which the painter may work. However, when utilizing ladders or scaffolds, it may not be possible to have a convenient, stable surface to support the paint can.

Also, when utilizing a ladder while painting with a paintbrush in one hand and the paint can in the other, the painter does not have a free hand to grasp the ladder (or some other structure) to remain steady against any loss of balance. Furthermore, the painter must constantly maintain the paint can in a vertical position to prevent any paint spillage. Maintaining the paint can in a vertical position is especially difficult when ascending or descending a ladder or when painting overhead. Furthermore, paint spillage often occurs when the painter must use both hands to maintain his balance or to prevent himself from falling.

With regard to carrying or holding a paint can, one-gallon-sized paint cans are generally equipped with a semicircular metal wire handle or bail. However, manually holding the paint can for an extended period of time is problematic due to the bail causing localized stress or pain on the user's fingers. Also, holding the paint can's bail while simultaneously dipping the paint brush is cumbersome due to interference occurring between the brush and the hand holding the handle/bail over the top of the can.

Unlike gallon-sized cans, which generally include the aforementioned handles or bails, quart-sized and pint-sized cans generally do not have either. When working with such paint cans, it is difficult for most individuals to grip the can for long periods without risking spillage. This is because the hand often gets fatigued when holding the wide grip necessary to clutch the can. Paint cans also become slippery when the outside of the cans get wet from paint spilled or dripped thereon during use, thus making them difficult or unpleasant to hold.

Because painting tasks are rarely competed without interruption, a placement of the paint-laden brush during any such interruption often presents itself as a concern. Less experienced painters often make the mistake of placing the brush atop the rim of the paint can after unloading as much paint from the bristles as possible. This nonetheless often results in paint drips on the outside of the container, the floor, or other surface, resulting in the need to clean such surfaces.

It is therefore desirable to have a device that will free the painter from holding the paint can when working in precarious positions while still nonetheless providing ready access to the paint. Because paint is packaged in variously sized containers, the device should be adaptable for holding various-sized paint cans. The device should maintain the paint can in an upright position when carrying the can and removably lock the device and can to one another during use. The device should also provide a practical means and location for storing the paint brush in relation to the can. The present invention thus provides these and other advantages.

SUMMARY OF THE INVENTION

A paint can typically comprises a cylindrical container having a lower surface and defining an interior. An upper circumferal groove and lip and lower circumferal lip are typically defined on the paint can at the respective upper and lower perimeters of the can's cylindrical side surface. The upper groove and lip and lower lip of the can are noteworthy because they are utilized by the paint can holder of the present invention to secure and hold the paint can. In one embodiment, a paint can holder for holding a paint can having an upper groove and lower lip comprises a bracket defining upper and lower ends, with the lower end defining a groove configured to accept the lower lip of the can therein. A clip and a lock operably are attached to the bracket proximal to the upper end. The lock is separated from the groove by a predetermined distance and operably engageable with the upper groove of the can to removably secure the holder and can to one another. The clip operably engageable with a belt or article of clothing to removably secure the paint can holder thereto. The holder preferably further comprises a magnet located on the lock and configured for magnetic engagement with a ferrous bristle binding of a paint brush to suspend the brush's bristles within about an interior of the can. In another embodiment, the paint can holder is adjustable to accommodate the holding of various sizes of the paint.

DESCRIPTION OF THE EMBODIMENTS

Figure 2:
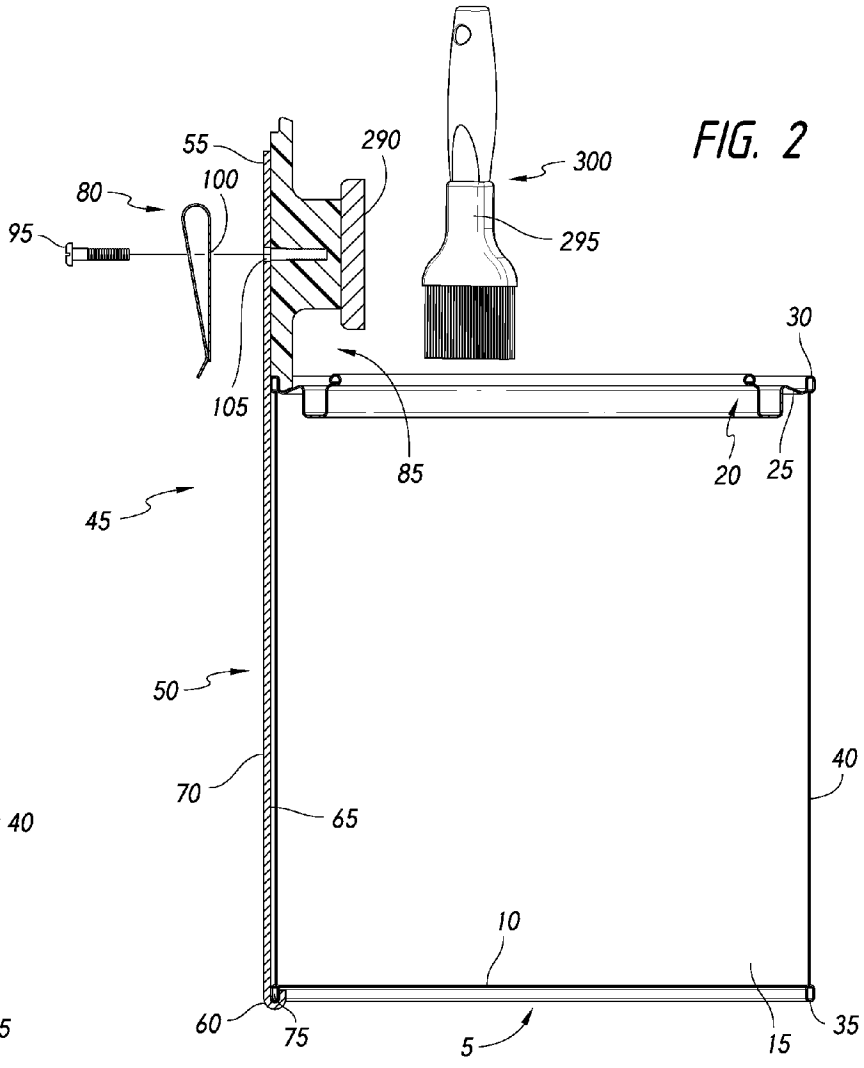
FIG. 2 is a side elevation view of the holder and paint can of FIG. 1 illustrating both the holder and can in section.
Figure 1:
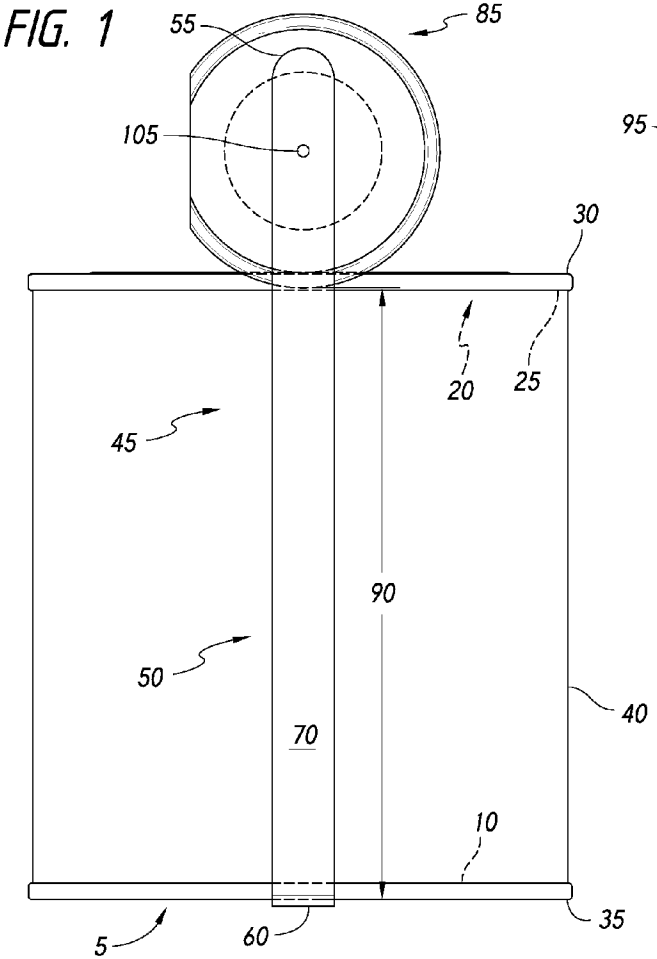
FIG. 1 is rear elevation view of one embodiment of the holder and paint can.

Referring initially to FIGS. 1 and 2, a paint can 5 typically comprises a cylindrical container having a lower surface 10 and defining an interior 15. Of course, an upper opening 20 is defined in the can and configured to matingly accept a lid (not shown) therein to seal the can. An upper circumferal groove 25 and lip 30 and lower circumferal lip 35 are typically defined on the paint can 5 at the respective upper and lower perimeters of the can's cylindrical side surface 40. The upper groove and lip and lower lip of the can are noteworthy because they are utilized by the paint can holder of the present invention to secure and hold the paint can.

In one embodiment of the invention illustrated in FIGS. 1 and 2, the paint can holder 45 comprises a bracket 50 defining upper and lower ends 55 and 60 and inner and outer sides 65 and 70. The bracket comprises a fillet or narrow strip of metal, plastic or other material having similar strength and durability properties. The lower end 60 of the bracket 50 defines a groove 75 configured to accept the lower lip 35 of the paint can therein while a clip 80 and a lock 85 are operably attached to the bracket proximal to its upper end 55. The groove 75, located on the inner side 65 of the bracket 50, is upwardly directed and oriented substantially perpendicular to an imaginary line drawn between the bracket's upper and lower ends 55 and 60. The groove is also slightly arcuate or curved to follow the round periphery of the can's lower lip 35.

The lock 85 is operably engageable with the upper groove 25 of the can 5 and separated from the bracket's groove 75, when engaged, by a predetermined distance 90 to removably secure the holder 45 and can to one another. In a preferred embodiment, the lock is comprised of a rigid plastic material. However, it is understood the lock may be comprised of other materials, such as rubber, wood or metal or any other material understood in the art. In one embodiment, the operable attachment of the lock 85 to the bracket 50 comprises a rotatable attachment via a screw 95 driven into the lock through bores 100 and 105 respectively defined in the clip 80 and bracket. The screw is driven to a tightness that allows the lock 85 and screw 95 to rotate in relation to the bracket 50 (i.e., not too tight as to snug the lock against the bracket).

Figure 3:
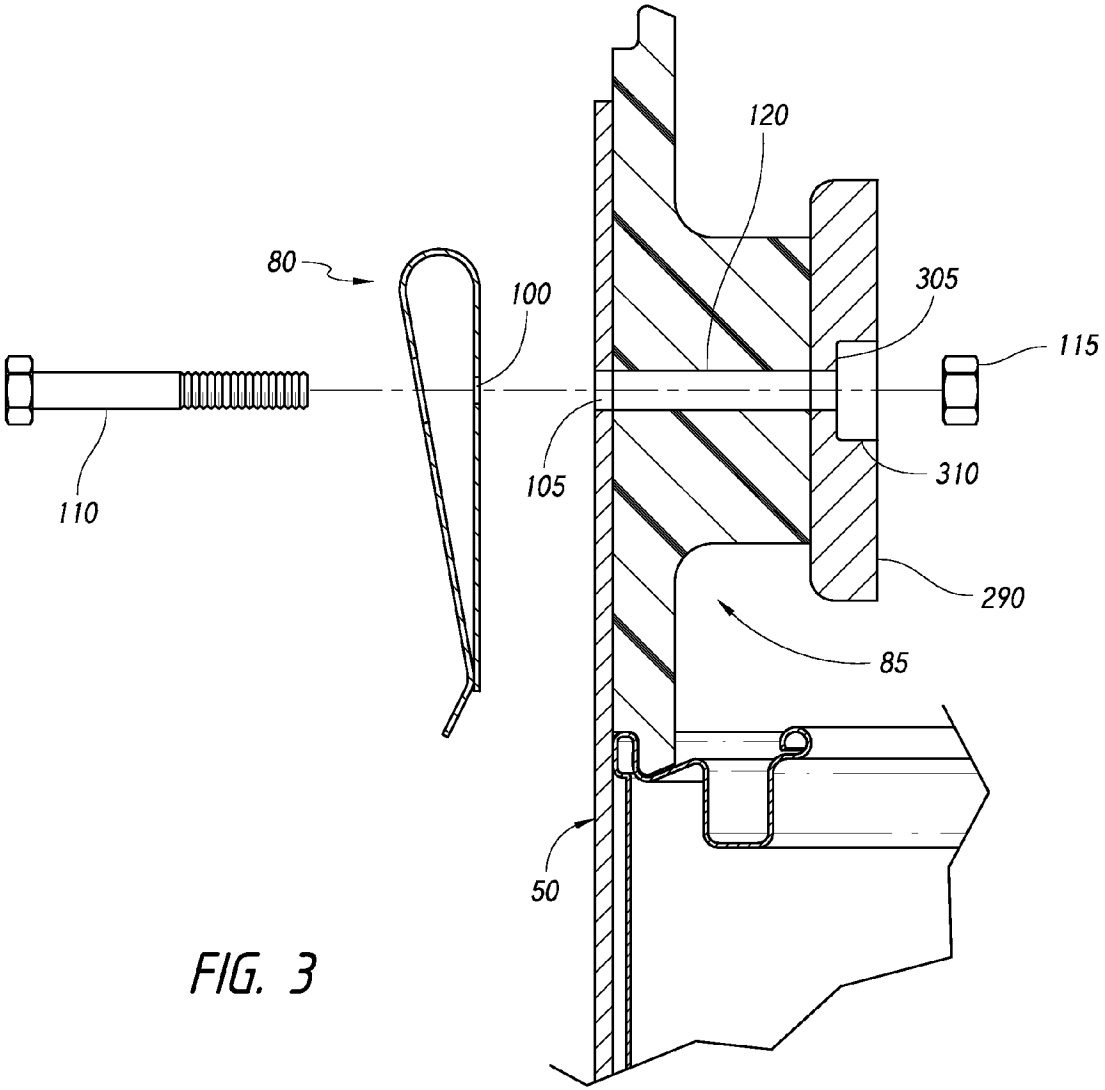
FIG. 3 is a side sectional elevation illustrating an alternate means of rotatably connecting the lock to the bracket and clip of the holder.

In another embodiment, illustrated by example in FIG. 3, the operable attachment of the clip 80 and lock 85 to the bracket 50 comprises a rotatable attachment via a hex bolt 110 and mating hex nut 115. The lock thus defines a bore 120 aligned coaxially with the clip and bracket bores 100 and 105 such that the bolt may be inserted through each and secured to the nut. The bolt 110 and nut 115 are threaded to one another to a tightness that allows the lock 85 to rotate in relation to the bracket 50 (i.e., not too tight as to snug the lock against the bracket). It is understood however, that other means and mechanism understood in the art may be utilized to rotatably connect the lock to the bracket. For example, a common bolt may be substituted for the screw of FIG. 3 for mating relation with a threaded bore defined in the lock lying coaxial with the clip and bracket bores.

Referring to FIGS. 4-7, in one embodiment, the lock 85 comprises a disc 125 defining an outer circumferal surface 130 operably engageable with an inner surface 135 of the upper groove 25 of the can, with the outer circumferal surface defining a chord 140 therein to facilitate the operable engagement and disengagement of the lock in relation to the can. The chord 140 thus defines a flat segment in the round, outer periphery of the disc 125 and is rotatable, via a rotation of the disc, to define engagement and disengagement positions 145 and 150 of the lock 85 in relation to the can 5.

For the engagement and disengagement positions 145 and 150 of the lock 85 to work via a rotation of the disc 125, the lock itself, when engaged, is preferably positioned at about the predetermined distance 90 from the groove 75 located at the lower end 60 of the bracket 50. This predetermined distance is about the distance existing between the paint can's upper groove 25 and lower lip 35. Of course, the distance will vary in accordance with paint can size; a gallon-sized paint can will have a lip-to-lip distance of between about 7 inches and 7¾ inches; a quart-sized paint can will have a lip-to-lip distance of about 4 3/16 inches; and a pint-sized paint can will have a lip-to-lip distance of about 3 15/16 inches.

Figure 5:
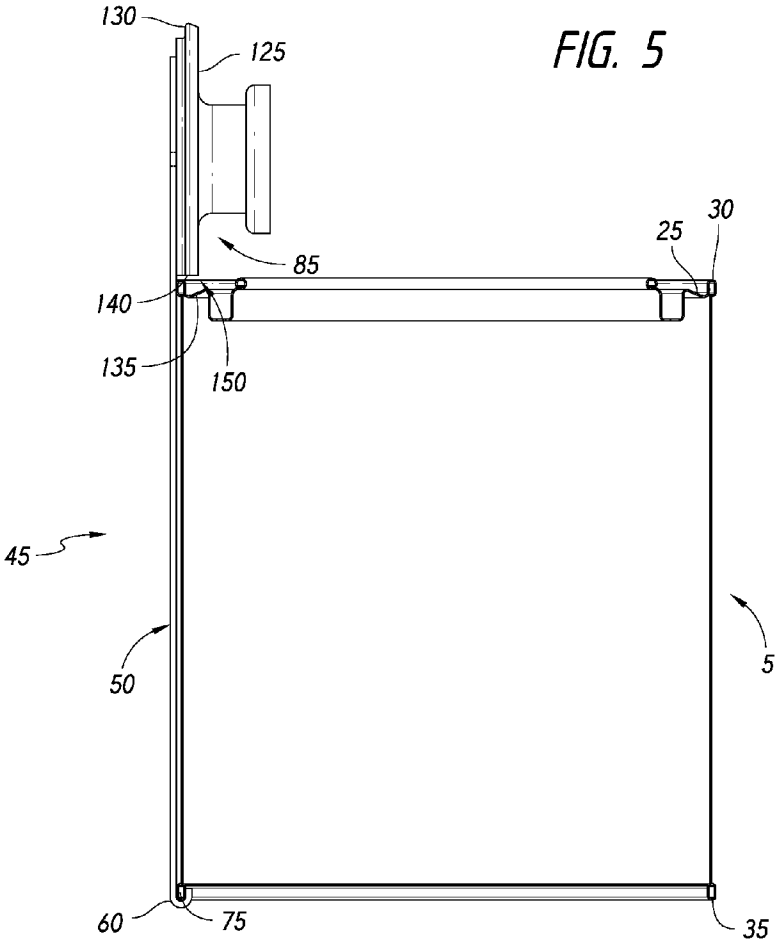
FIG. 5 is a side elevation view of the lock and paint can of FIG. 4, illustrating the can in section.
Figure 4:
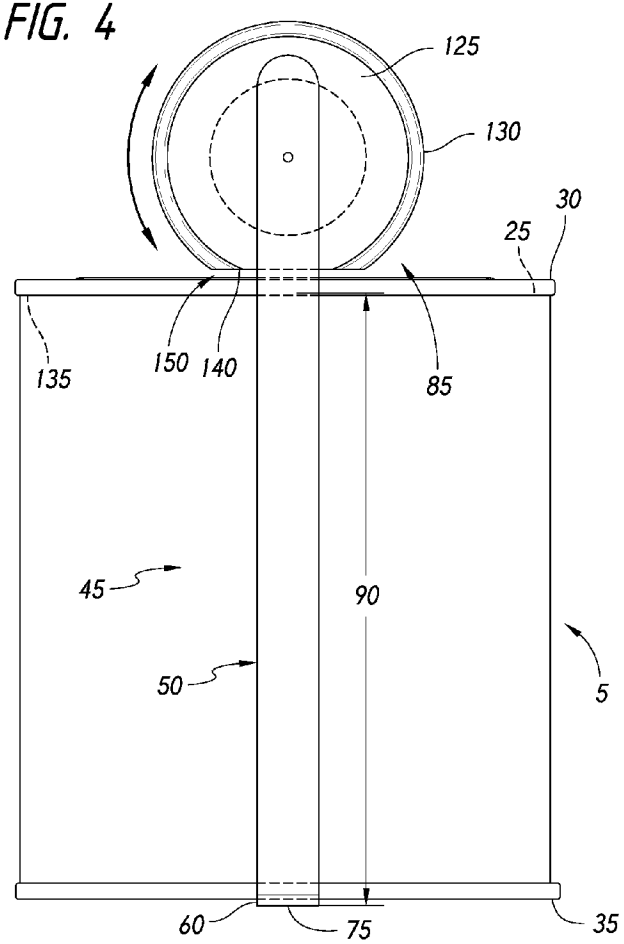
FIG. 4 is a rear elevation view of lock of the holder in a disengaged position.

Referring to FIGS. 4 and 5, with the lower lip 35 of the paint can 5 inserted into the bracket's groove 75 and the chord 140 of the lock's disc 125 rotated to a location about parallel with the groove, the predetermined distance of the paint can is utilized to ensure that the chord is parallel with and about adjacent to the outer edge of the paint can's upper lip 30. After the chord 140 of the lock's disc 125 is located about parallel with and adjacent to the outer edge of the paint can's upper lip 30, the disc is moved laterally inwardly towards the can's center until the chord is located about parallel with and adjacent to the can's upper groove 25. This defines the disengagement position 150 of the lock 85.

Figure 7:
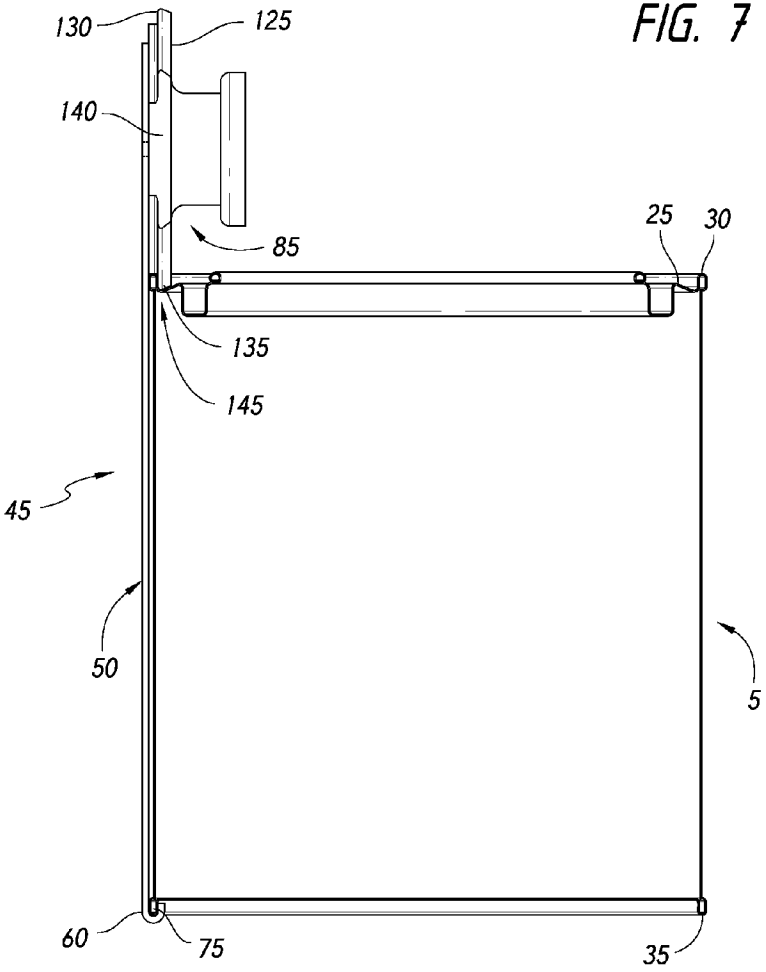
FIG. 7 is a side elevation view of the lock and paint can of FIG. 6, illustrating the can in section.
Figure 6:
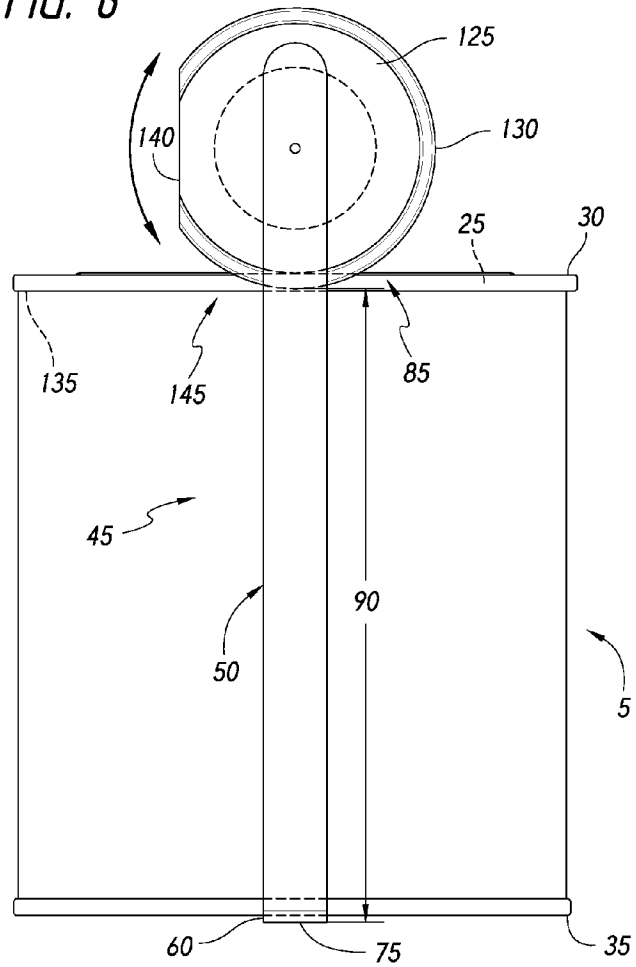
FIG. 6 is a rear elevation view of lock of the holder in a engaged position.

Referring to FIGS. 6 and 7, with the chord 140 located about parallel with and adjacent to the can's upper groove 25, the disc is thereafter rotated until its circumferal outer surface 130 comes into frictional contact with the inner surface 135 of the groove itself. When the disc's outer surface 130 in frictional contact with the groove's inner surface 135, the paint can 5 is now wedged between the bracket's lock 85 and groove 75 to secure the paint can to the holder 45. This defines the engagement position 145 of the lock 85.

In another embodiment of the invention, the lock comprises a substantially rectangular tab 151 defining at least one semi-circular outer edge 152 operably engageable with the inner surface 135 of the upper groove 25 of the can, with the outer edge movable to facilitate the operable engagement and disengagement of the lock in relation to the can. The outer edge 152 is rotatable, via a rotation of the tab 151, to define engagement and disengagement positions 145 and 150 of the lock 85 in relation to the can 5.

For the engagement and disengagement positions 145 and 150 of the lock 85 to work via a rotation of the tab 151, the lock itself, when engaged, is preferably positioned at about the predetermined distance 90 from the groove 75 located at the lower end 60 of the bracket 50. Again, this predetermined distance is about the distance existing between the paint can's upper groove 25 and lower lip 35, with the distance again varying in accordance with paint can size.

Figure 9:
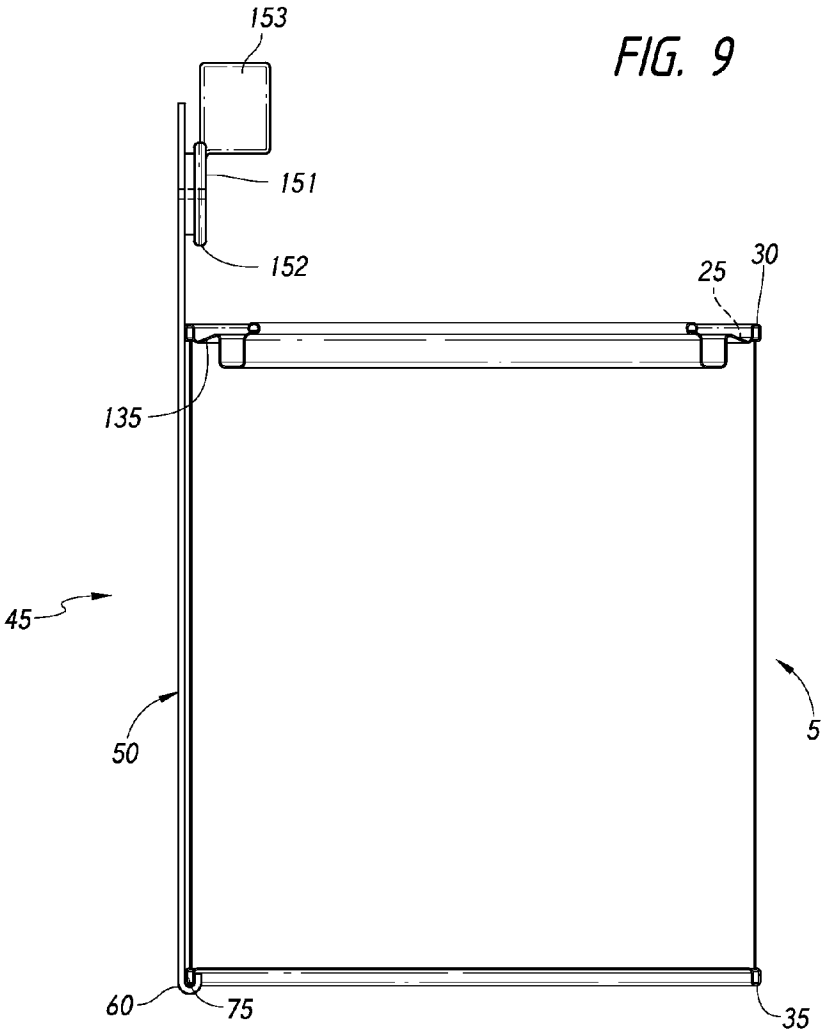
FIG. 9 is a side elevation view of the lock and paint can of FIG. 8, illustrating the can in section.
Figure 8:
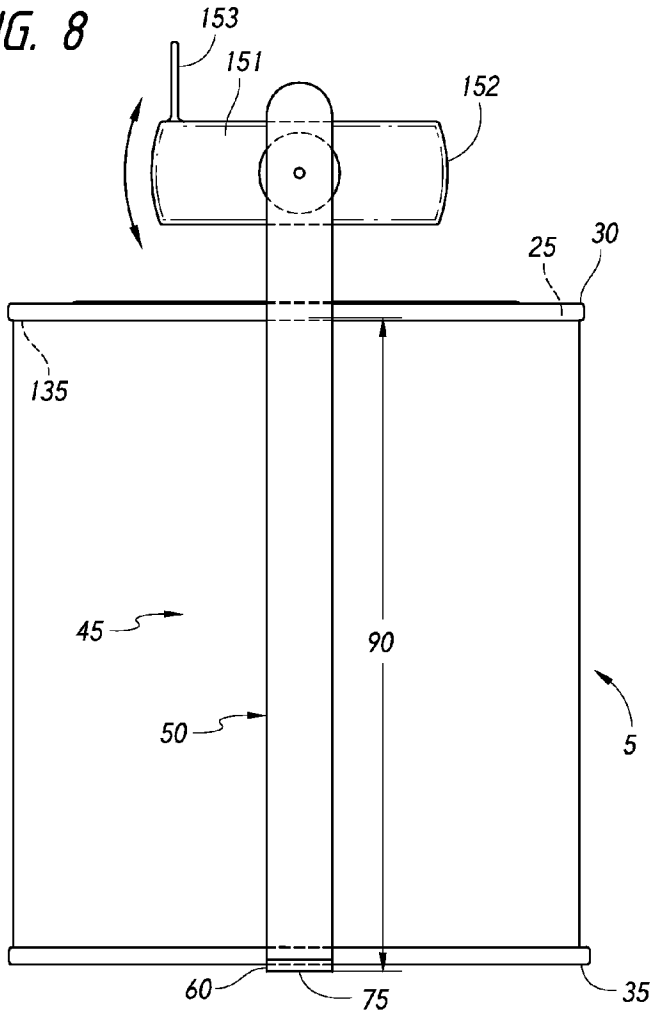
FIG. 8 is a rear elevation view of an alternate embodiment of the lock of the holder in a disengaged position.

Referring to FIGS. 8 and 9, with the lower lip 35 of the paint can 5 inserted into the bracket's groove 75 and the outer edge 152 of the tab 151 is rotated to a location about perpendicular with the groove, the predetermined distance of the paint can is utilized to ensure that the tab is about proximal to the outer edge of the paint can's upper lip 30. After the outer the tab 151 is located about proximal to the outer edge of the paint can's upper lip 30, the tab is moved laterally inwardly towards the can's center until the outer edge is also located about proximal to the can's upper groove 25. This defines the disengagement position 150 of the lock 85.

Figure 11:
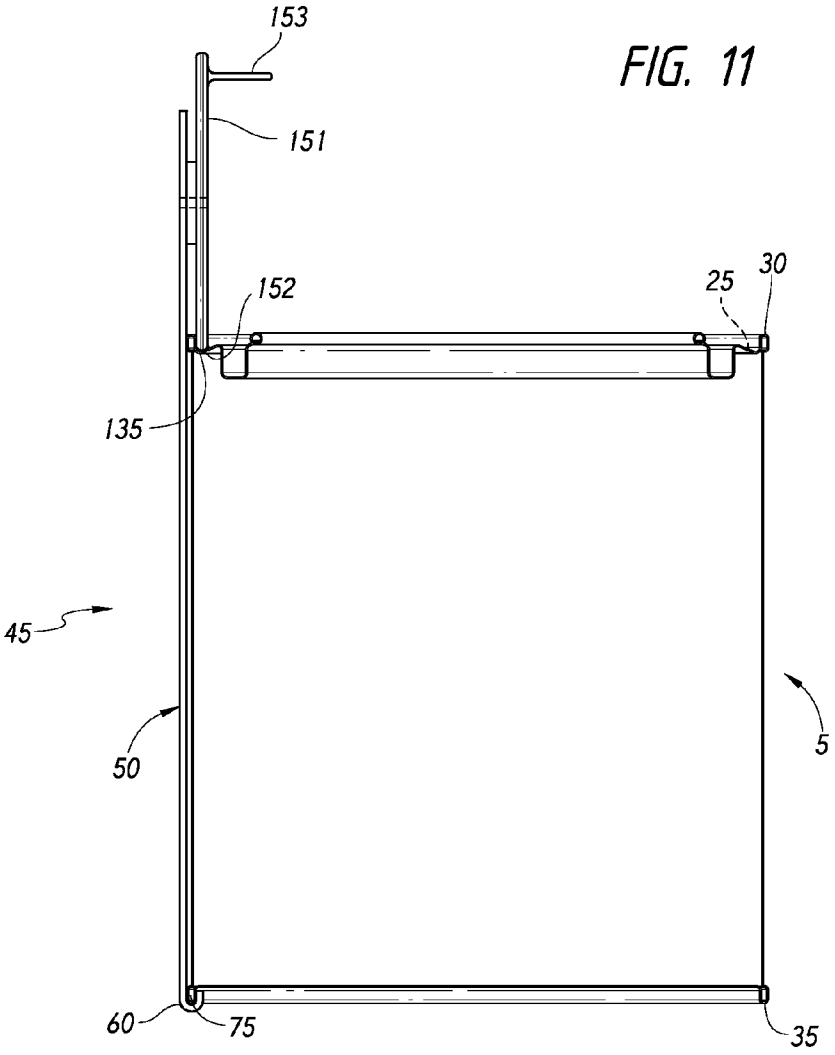
FIG. 11 is a side elevation view of the lock and paint can of FIG. 10, illustrating the can in section.
Figure 10:
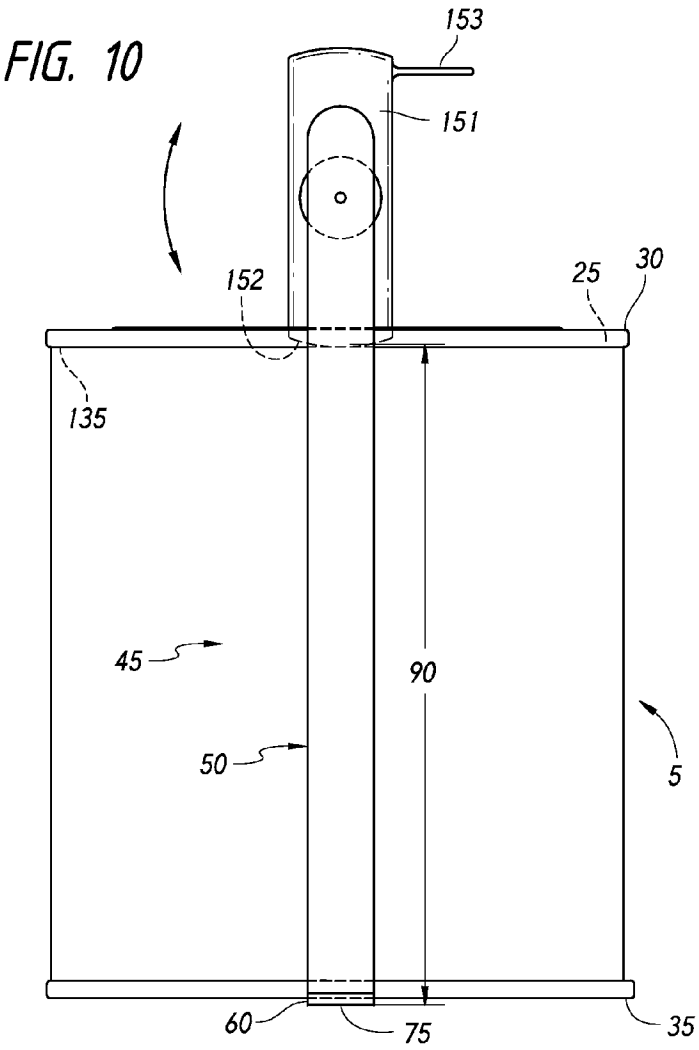
FIG. 10 is a rear elevation view of the alternate embodiment of the lock of the holder in a engaged position.

Referring to FIGS. 10 and 11, with the outer edge 152 located about proximal to the can's upper groove 25, the tab 151 is thereafter rotated until its outer edge comes into frictional contact with the inner surface 135 of the groove itself. When the tab's outer edge 152 is in frictional contact with the groove's inner surface 135, the paint can 5 is now wedged between the bracket's lock 85 and groove 75 to secure the paint can to the holder 45. This defines the engagement position 145 of the lock 85. As illustrated in FIGS. 8-11, a grip 153 is preferably located on the tab 151 to facilitate a gripping of the lock 85 by a user of the device to aid in rotating the lock between engaged and disengaged positions.

In one embodiment of the invention (i.e., FIGS. 1 and 2), the predetermined distance of the paint can holder's lock from the groove in fixed. Because the lip-to-lip distance of a gallon-sized paint can is greater than that a quart-sized paint can, which is greater than that of a pint-sized paint can, a paint can holder having a predetermined distance to accommodate a gallon-sized can would not fit a quart-sized can or pint-sized paint can, and vice-versa. Thus, differently sized paint can holders are utilized to accommodate each respectively sized paint can. However, in another embodiment of the invention, the predetermined distance 90 of the paint can holder's lock 85 from the groove 75 is adjustable to fit gallon-sized, quart-sized and pint-sized paint cans, as well as paint cans having other lip-to-lip distances.

Referring to FIGS. 12-15, an adjustment of the predetermined distance 90 from the lock 85 to the groove 75 is facilitated by an adjustable bracket 155 comprising upper and lower portions 160 and 165 defining overlapping sections 170 and 175 (FIG. 15) there-between. Each of the upper and lower portions, defining upper and lower ends 180, 185 and 190, 195 and inner and outer sides 200, 205 and 210, 215, comprises a fillet or a narrow strip of metal, plastic or other material having similar strength and durability properties. The lower end 195 of the lower portion 165 defines groove 75 configured to accept the lower lip 35 of the paint can therein while the clip 80 and a lock 85 are operably attached to the upper end 180 of the upper portion 160. The overlapping sections 170 and 175 (FIG. 15) are defined where the outer side of one portion lies adjacent to the inner side of the other portion. Each of the upper and lower portions 160 and 165 respectively define a through, elongated channel, 220 and 225 along each respective portion's length, with each channel defining upper and lower inner edges 230, 235 and 240, 245 as well as first and second inner lengthwise edges 250, 255 and 260, 265.

Figure 15:
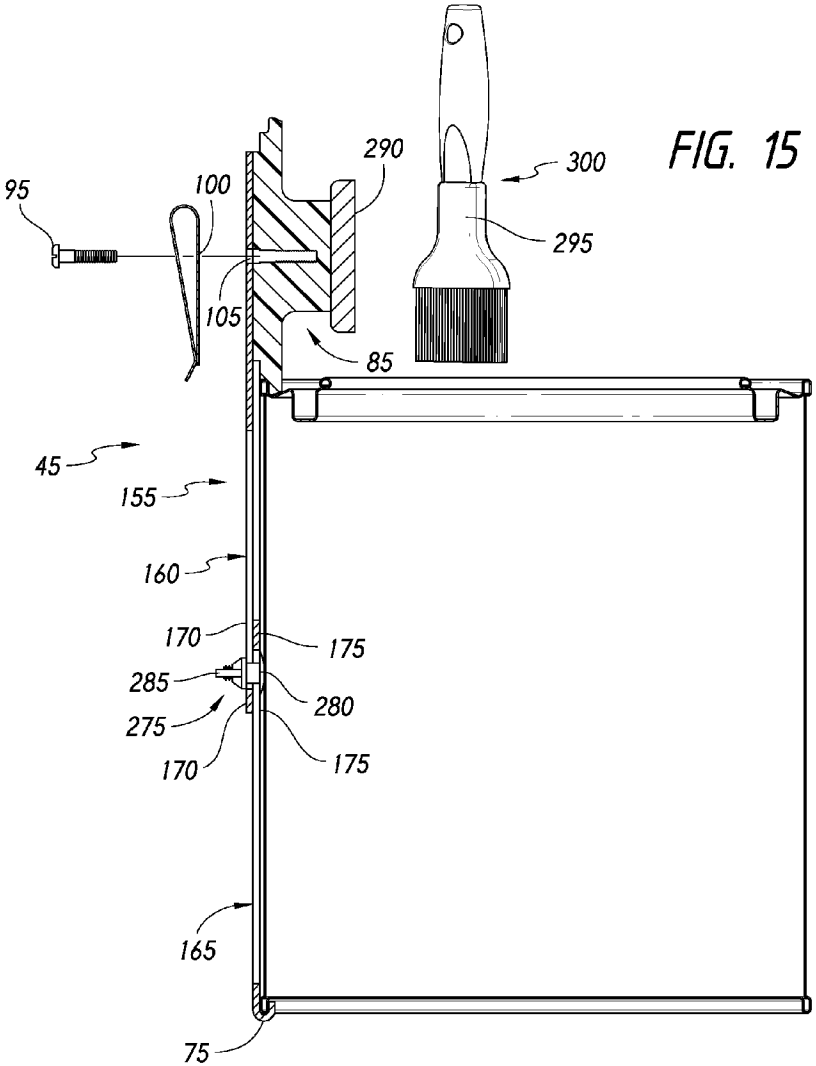
FIG. 15 is a side elevation view of the holder of FIG. 12 and paint can, illustrating both the holder and can in section.
Figure 14:
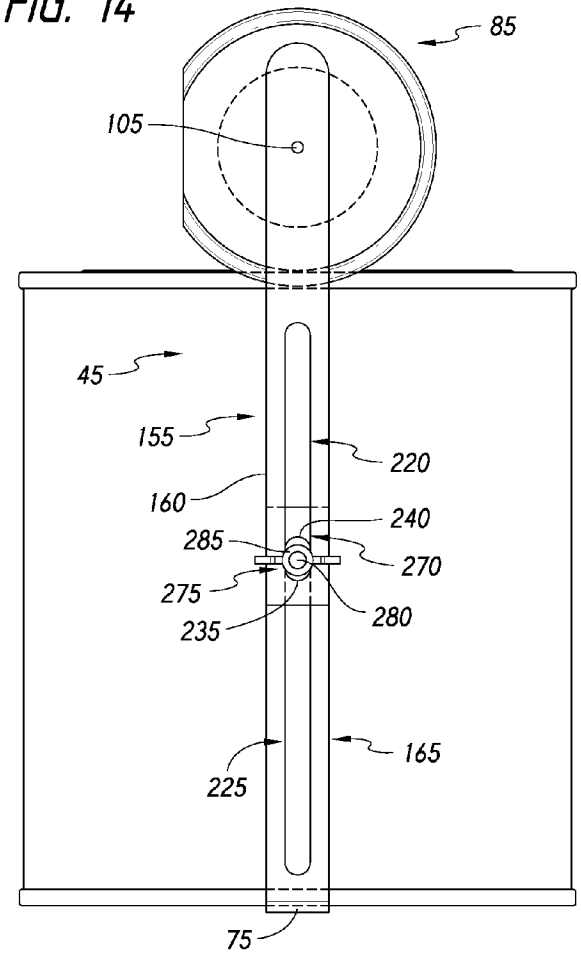
FIG. 14 is rear elevation view of the holder of FIG. 12 and paint can.

Referring to FIGS. 14 and 15, with the upper and lower portions 160 and 165 positioned adjacent to one another to define the overlapping sections 170 and 175, each portion's channel 220 and 225 is also positioned adjacent to one another such that their respective lengthwise inner edges 250, 255 and 260, 265 lie about coterminous with one another to define an adjustable channel 270 of variable length. The variable length of the adjustable channel 270 is defined between the lower inner edge 235 of the upper portion's channel 220 and the upper inner edge 240 of the lower portion's channel 225. A securing mechanism 275 is operably associated with the adjustable channel 270 between the lower inner edge 235 of the upper portion's channel 220 and the upper inner edge 240 of the lower portion's channel 225. The mechanism movably secures the upper and lower portions 160 and 165 of the adjustable bracket 155 to one another at its overlapping sections 170 and 175 to define at least two predetermined distances between the upper portion's lock 85 and the lower portion's groove 75.

In one embodiment of the adjustable bracket, the at least two pre-determined distances define those respective distances existing between a gallon-sized paint can's upper groove and lower lip and a quart-sized paint can's upper groove and lower lip. In another embodiment of the adjustable bracket, the at least two pre-determined distances define those respective distances existing between a quart-sized paint can's upper groove and lower lip and a pint-sized paint can's upper groove and lower lip.

Figure 13:
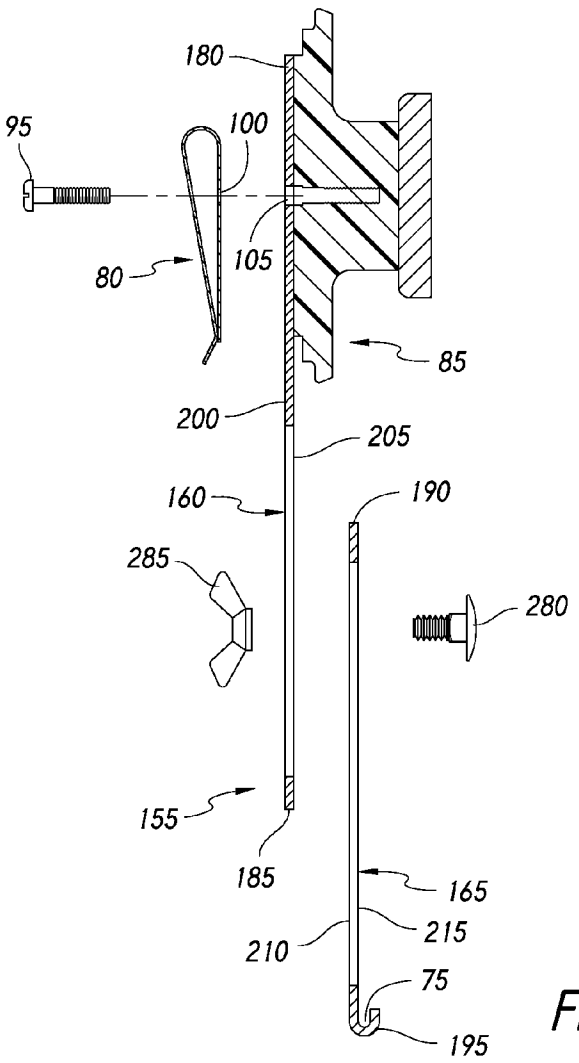
FIG. 13 is a side elevation assembly view of the holder of FIG. 12 illustrating the holder in section.
Figure 12:
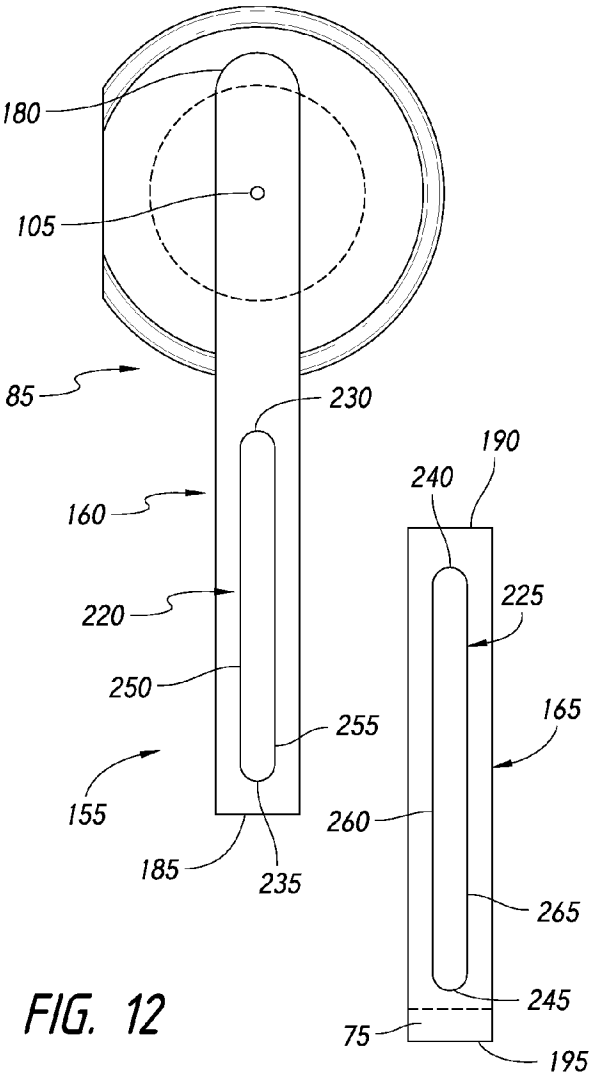
FIG. 12 is a rear elevation assembly view of an adjustable embodiment of the holder.

As illustrated in the embodiment of FIGS. 13-15, the securing mechanism 275 preferably comprises a step bolt 280 inserted through the adjustable channel 270 and fastened to a wing nut 285. The head of the step bolt is preferably located on the inner side (i.e., the can side) of the adjustable bracket while the wing nut is located on the bracket's outer side. This configuration allows a user to readily access the wing nut to tighten and loosen it accordingly in relation to the step bolt. A tightening of the wing nut will secure the upper and lower portions to one another to maintain one of the at least two predetermined distances of the adjustable bracket while a loosening of the wing nut will release them from one another for the selection of another of the at least two predetermined distances.

Thus, with the securing mechanism 275 in a tightened position, the adjacent surfaces of the overlapping sections 170 and 175 of the adjustable bracket's upper and lower portions 160 and 165 will releasably bind with one another, via a frictional engagement of the adjacent surfaces, to maintain one of the at least two predetermined distances of the adjustable bracket defined between the lower portion's groove 75 and the upper portion's lock 85. The inner and/or outer surfaces of the upper and lower portions may be textured to improve the ability of the adjacent surfaces of the overlapping sections to bind to one another when the securing mechanism is in the tightened position. Such textured surfaces include mating toothed, grooved, grained or any other surface capable of increasing a frictional contact with another surface.

A spring-lock washer or internal or external tooth lock washer may be located on the step bolt between the wing nut and exterior side of the adjustable bracket to releasably lock the wing nut in a tightened position. While a step bolt and wing nut comprise the securing mechanism of FIGS. 12-15, it is understood that other common fasteners would suffice as well, to include without limitation on combinations thereof, hex bolts, machine screws hex nuts, clinch nuts, etc.

As illustrated in FIGS. 2 and 3, the clip 80 of the paint can holder 45 operably engages a belt or article of clothing to removably secure the paint can holder thereto. The clip 80 comprises a narrow U-shaped or hook-shaped piece of metal, plastic or similar material understood in the art. In one embodiment of the invention (FIG. 2), the clip 80 is attached to the holder 45 via a screw 95 inserted through axially aligned bores 100 and 105 defined through the clip and bracket 50 (or adjustable bracket 155) and driven into the lock 85. The screw 95 is driven to a tightness that allows the bracket 50 or 155 to rotate about the screw in relation to the clip 80 and lock 85 (i.e., not too tight as to snug the clip and lock against the bracket) to thus allow the bracket to hang freely in relation to the clip. The clip may also be attached to the holder via the hex bolt and hex nut configuration illustrated in FIG. 3.

In yet another embodiment of the paint can holder 45, a magnet 290 is located on the lock 85 and configured for magnetic engagement with the ferrous bristle binding 295 of a common paint brush 300 to suspend the bristles of the brush within about the in interior 15 of the can 5. In the embodiment illustrated in FIGS. 1-2, 4-7 and 12-15, the magnet 290 is mounted to the disc 125 of the lock 85, about coaxial therewith, and on a side of the lock opposite that of the bracket 50 or 155. A common adhesive is utilized to mount the magnet to the lock. In another embodiment of the invention (FIG. 3), the magnet 290 is attached to the disc 125 of the lock 85 via a coaxial bore 305 and counter bore 310 defined through the magnet and lying coaxial with the lock, bracket and clip bores 120, 105 and 100, with the bolt 110 inserted through the bores and secured with the hex nut 115. However, it is understood that magnet may be attached to the disc of the lock via any means understood in the art. Also, it is understood that the magnet may lie on the inner side of the tab 151 of FIGS. 8-11 as well. Furthermore, it is further understood that the paint can holder may not utilize any magnet whatsoever, thus illustrating the holder without magnet 290 located on the lock 85 (i.e., FIGS. 8-11).

In use in one embodiment of the invention, a paint can is inserted between the groove defined at the lower end of the bracket and the lock, located proximal to the upper end of the bracket. With the can's lower lip inserted within the groove of the bracket's lower end, the chord of the lock's disc is moved over the can's upper lip and to a location directly above the can's upper groove. The lock is thereafter engaged by rotating the lock's disc such that the disc's round, outer periphery is in frictional contact with the inner surface of the can's upper groove, thereby wedging the paint can between the lock and groove of the bracket to secure the paint can to the holder.

The paint can holder and associated paint can is thereafter clipped to a belt or article of clothing to suspend the holder and can therefrom. The ferrous bristle binder of the paint brush may thereafter be placed against a magnet of the paint can holder to suspend the bristles of the brush within the interior of the can. After painting activities have commenced, the lock of the can holder is disengaged by rotating the lock's disc such that the chord of the lock's disc is again located over the can's upper groove. The can is thereafter removed from underneath the lock by moving the can's upper lip past the disc's chord and the can's lower lip is thereafter removed from the bracket's groove to thereby remove the can from the holder.

In use in another embodiment of the invention, the securing means of the adjustable bracket is loosened such that the adjacent surfaces of the overlapping sections of the bracket's upper and lower portions and will release from one another. The variable length of the adjustable channel now allows for a selection at least two predetermined distances between the upper portion's lock and the lower portion's groove. The securing mechanism is again tightened to bind the overlapping sections of the adjustable bracket's upper and lower portions to one another. A paint can possessing the predetermined distance between its upper groove and lower lip is inserted between the groove defined at the lower end of the bracket and the lock, located proximal to the upper end of the bracket. With the can's lower lip inserted within the groove of the bracket's lower end, the chord of the lock's disc is moved over the can's upper lip and to a location directly above the can's upper groove. The lock is thereafter engaged by rotating the lock's disc such that the disc's round, outer periphery is in frictional contact with the inner surface of the can's upper groove, thereby wedging the paint can between the lock and groove of the bracket to secure the paint can to the holder.

The paint can holder and associated paint can is thereafter clipped to a belt or article of clothing to suspend the holder and can therefrom. The ferrous bristle binder of the paint brush may thereafter be placed against a magnet of the paint can holder to suspend the bristles of the brush within the interior of the can. After painting activities have commenced, the lock of the can holder is disengaged by rotating the lock's disc such that the chord of the lock's disc is located over the can's upper groove. The can is thereafter removed from underneath the lock by moving the can's upper lip past the disc's chord and the can's lower lip is thereafter removed from the bracket's groove to thereby remove the can from the holder. At this point, the securing mechanism of the adjustable bracket may be loosened again to release the overlapping sections of the adjustable bracket's upper and lower portions from one another. The variable length of the adjustable channel now again allows for a selection at least two predetermined distances between the upper portion's lock and the lower portion's groove for the accommodation of another sized can there-between.

In use in one embodiment of the invention, a paint can is inserted between the groove defined at the lower end of the bracket and the lock, located proximal to the upper end of the bracket. With the can's lower lip inserted within the groove of the bracket's lower end, the outer edge of the lock's tab is moved over the can's upper lip and to a location directly above the can's upper groove. The lock is thereafter engaged by rotating the lock's tab such that the tab's outer edge is in frictional contact with the inner surface of the can's upper groove, thereby wedging the paint can between the lock and groove of the bracket to secure the paint can to the holder.

The paint can holder and associated paint can is thereafter clipped to a belt or article of clothing to suspend the holder and can therefrom. The ferrous bristle binder of the paint brush may thereafter be placed against a magnet of the paint can holder to suspend the bristles of the brush within the interior of the can. After painting activities have commenced, the lock of the can holder is disengaged by rotating the lock's tab such that the outer edge of the lock's tab is again located over the can's upper groove. The can is thereafter removed from underneath the lock by moving the can's upper lip past the tab's outer edge and the can's lower lip is thereafter removed from the bracket's groove to thereby remove the can from the holder.

In use in another embodiment of the invention, the securing means of the adjustable bracket is loosened such that the adjacent surfaces of the overlapping sections of the bracket's upper and lower portions and will release from one another. The variable length of the adjustable channel now allows for a selection at least two predetermined distances between the upper portion's lock and the lower portion's groove. The securing mechanism is again tightened to bind the overlapping sections of the adjustable bracket's upper and lower portions to one another. A paint can possessing the predetermined distance between its upper and lower lips is inserted between the groove defined at the lower end of the bracket and the lock, located proximal to the upper end of the bracket. With the can's lower lip inserted within the groove of the bracket's lower end, the outer edge of the lock's tab is moved over the can's upper lip and to a location proximal to the can's upper groove. The lock is thereafter engaged by rotating the lock's tab such that the tab's outer edge is in frictional contact with the inner surface of the can's upper groove, thereby wedging the paint can between the lock and groove of the bracket to secure the paint can to the holder.

The paint can holder and associated paint can is thereafter clipped to a belt or article of clothing to suspend the holder and can therefrom. The ferrous bristle binder of the paint brush may thereafter be placed against a magnet of the paint can holder to suspend the bristles of the brush within the interior of the can. After painting activities have commenced, the lock of the can holder is disengaged by rotating the lock's tab such that the outer edge of the lock's tab is located proximal to the can's upper groove. The can is thereafter removed from underneath the lock by moving the can's upper lip past the tab's outer edge and the can's lower lip is thereafter removed from the bracket's groove to thereby remove the can from the holder. At this point, the securing mechanism of the adjustable bracket may be loosened again to release the overlapping sections of the adjustable bracket's upper and lower portions from one another. The variable length of the adjustable channel now again allows for a selection at least two predetermined distances between the upper portion's lock and the lower portion's groove for the accommodation of another sized can there-between.

We claim:

1. A paint can holder for holding a paint can having an upper groove and lower lip, the holder comprising:

a bracket defining upper and lower ends, the lower end defining a groove configured to accept the lower lip of the can therein; and a clip and a lock operably attached to the bracket proximal to the upper end, the lock rotatably engageable with the upper groove of the can and separated, when engaged, from the bracket's groove by about a predetermined distance to removably secure the holder and can to one another, the clip operably engageable with a belt or article of clothing to removably secure the paint can holder thereto, the lock comprising a disc defining an outer circumferal surface operably engageable with the upper groove of the can, the outer circumferal surface defining a chord therein to facilitate the operable engagement and disengagement of the lock in relation to the can.

2. The paint can holder of claim 1 further comprising a magnet located on the lock and configured for magnetic engagement with a ferrous bristle binding of a paint brush to suspend the brush's bristles about within an interior of the can.

3. The paint can holder of claim 1 wherein the predetermined distance is between about 7 inches and about 7¾ inches.

4. The paint can holder of claim 1 wherein the predetermined distance is about 4 3/16 inches.

5. The paint can holder of claim 1 wherein the predetermined distance is about 3 15/16 inches.

6. The paint can holder of claim 1 wherein the predetermined distance is adjustable by an adjustable bracket to accommodate various sizes of the paint can there-between.

7. The paint can holder of claim 6 wherein the adjustable bracket is adjustable to define at least two predetermined distances between the holder's lock and groove.

8. The paint can holder of claim 7 wherein the at least two predetermined distances respectively define about the distances existing between a gallon-sized paint can's and a quart-sized paint can's upper groove and lower lip.

9. The paint can holder of claim 7 wherein the at least two predetermined distances respectively define about the distances existing between a quart-sized paint can's and a pint-sized paint can's upper groove and lower lip.

10. The paint can holder of claim 6 wherein the adjustable bracket comprises two portions defining an adjustable channel, the two portions adjustably secured to one another with a securement mechanism.

11. The paint can holder of claim 1 wherein the operable attachment of the clip to the bracket defines a rotatable attachment.

12. A paint can holder for holding a paint can having an upper groove and lower lip, the holder comprising:

a bracket defining upper and lower ends, the lower end defining a groove configured to accept the lower lip of the can therein; and a clip and a lock operably attached to the bracket proximal to the upper end, the lock rotatably engageable with the upper groove of the can and separated, when engaged, from the bracket's groove by about a predetermined distance to removably secure the holder and can to one another, the clip operably engageable with a belt or article of clothing to removable secure the paint can holder thereto, the lock comprising a substantially rectangular tab defining at least one semi-circular outer edge operably engageable with the upper groove of the can.

13. The paint can holder of claim 12 further comprising a magnet connected to the lock and configured for magnetic engagement with a ferrous bristle binding of a paint brush to suspend the brush's bristles within about an interior of the can.

14. The paint can holder of claim 12 wherein the predetermined distance is adjustable by an adjustable bracket to accommodate various sizes of the paint can there-between.

15. A method of holding a paint can having an upper groove and lower lip, the method comprising:

inserting a paint can between a groove defined at a lower end of a bracket and a lock located proximal to an upper end of the bracket, the groove accepting the lower lip of the can therein, the lock comprising a disc defining an outer circumferal surface operably engageable with the upper groove of the can, the outer circumferal surface defining a chord therein to facilitate an operable engagement and disengagement of the lock in relation to the can;

rotating the lock between engagement and disengagement positions in relation to the upper groove of the can; and clipping a clip of the holder to a belt or article of clothing.

16. The method of claim 15 further comprising resting a ferrous bristle binding of a paint brush against a magnet of the holder to suspend the brush's bristles within about an interior of the paint can.

17. The method of claim 15 further comprising adjusting a distance defined between the lock and the groove with an adjustment means to accommodate the size of the can inserted there between.

18. A method of holding a paint can having an upper groove and lower lip, the method comprising:

inserting a paint can between a groove defined at a lower end of a bracket and a lock located proximal to an upper end of the bracket, the groove accepting the lower lip of the can therein, the lock comprising a substantially rectangular tab defining at least one semi-circular outer edge operably engageable with the upper groove of the can;

rotating the lock between engagement and disengagement positions in relation to the upper groove of the can; and clipping a clip of the holder to a belt or article of clothing.

19. The method of claim 18 further comprising resting a ferrous bristle binding of a paint brush against a magnet of the holder to suspend the brush's bristles within about an interior of the paint can.

20. The method of claim 18 further comprising adjusting a distance defined between the lock and the groove with an adjustment means to accommodate the size of the can inserted there between.

* * * * *